United States Patent [19]

Phillips et al.

[11] Patent Number: 4,965,420

[45] Date of Patent: Oct. 23, 1990

[54] SWITCH ACTUATOR

[75] Inventors: William C. Phillips, Aurora; James F. L. Blair, St. Charles, both of Ill.

[73] Assignee: Saint Switch, Inc., St. Charles, Ill.

[21] Appl. No.: 410,347

[22] Filed: Sep. 21, 1989

[51] Int. Cl.[5] ..... H01H 3/48; H01H 13/70

[52] U.S. Cl. ..... 200/341; 200/342; 200/345; 200/521; 200/523; 200/573

[58] Field of Search ..... 200/342, 341, 345, 5 A, 200/520, 521, 573

[56] References Cited

U.S. PATENT DOCUMENTS

| | | | |
|---|---|---|---|
| 2,547,765 | 4/1951 | Lund | 200/342 X |
| 2,697,364 | 12/1954 | Koch | 200/342 X |
| 3,165,611 | 1/1965 | Hagberg | 200/342 X |
| 4,613,737 | 9/1986 | Nishijima | 200/342 |
| 4,778,960 | 10/1988 | Blair | 200/342 X |

FOREIGN PATENT DOCUMENTS

| | | | |
|---|---|---|---|
| 0893139 | 4/1962 | United Kingdom | 200/342 |

*Primary Examiner*—Ernest G. Cusick

*Attorney, Agent, or Firm*—Wood, Phillips, Mason, Recktenwald & VanSanten

[57] ABSTRACT

A switch actuator includes a base and a plunger mounted for movement on the base. An electrical contact is mounted for relative movement on the base to establish an electrical connection. An actuator includes a head portion and a pair of spring arms. The spring arms extend into a bore in the plunger for frictionally grasping the plunger by spring biased forces against the interior walls of the bore. The actuator has a head portion exposed from an open end of the plunger bore for effecting movement of the electrical contact to alter the state of the electrical connection. The frictional engagement between the spring arms and the plunger provide overtravel or relative movement therebetween and the affect of the spring arms substantially eliminates any affect from wear between the plunger and the actuator.

14 Claims, 2 Drawing Sheets

SWITCH ACTUATOR

FIELD OF THE INVENTION

This invention generally relates to the art of electrical switches and, particularly, to electrical switches which incorporate overtravel either in the switch itself or in an actuating mechanism attached to or operatively associated with the switch or switch contacts.

BACKGROUND OF THE INVENTION

Many electrical switches are of the type which encounter "overtravel" after the state of the electrical connection of the switch has been altered. In most instances, an actuator is employed to operate the switch. The actuator and its associated components usually go through a "pretravel" before electrical connection is made or the switch state is altered, which sometimes is termed the "operating point". The actuator and/or its associated components go through an overtravel condition of movement after the operating point. Upon release of the actuator, reverse movement usually takes place and a "release point" occurs when the electrical connection and its associated circuit is transferred back to its original state. This usually occurs sometime during return movement of the actuator.

In some instances, such as shown in U.S. Pat. No. 4,778,960 to James Blair, dated Oct. 18, 1988 and assigned to the assignee of this invention, a floating, operating and release point switch is disclosed. This concept allows the switch to utilize a movement differential to actuate or deactuate a circuit rather than cause actuation or deactuation at respective absolute positions. In this patent, a switch actuator includes a base and a plunger mounted for movement in the base. A friction piece surrounds the plunger and normally frictionally grasps the plunger so as to be movable therewith and relatively movable with respect to the plunger when movement of the friction piece is resisted, as by engagement with switch contacts. The plunger, therefore, overtravels the friction piece once contact is made. On return movement of the plunger, the friction piece again frictionally grasps the plunger and moves away from the switch contacts. In other words, conjoint and relative movement between the plunger and the friction piece in this switch actuator relies upon maintaining a friction surface between the plunger and the friction piece.

In copending U.S. application Ser. No. 243,506, filed Sept. 8, 1988, and assigned to the assignee of the present invention, an improved switch actuator is shown wherein a plunger is mounted on a base for movement relative thereto to establish an electrical connection. Actuator means are operatively associated with the plunger and include wedge means between the plunger and an actuator member. Such a structural combination accommodates manufacturing tolerances and compensates for wear during use. However, the switch actuator again relies upon frictional surfaces to provide conjoint and relative movement between the plunger and the switch actuating means.

This invention is directed to further improvements in such switch actuators and substantially eliminates any wear problems by eliminating total reliance on maintaining frictional surfaces by providing a spring loading between the actuating member and the plunger, with spring bias forces facilitating conjoint and relative movement therebetween. The actuator is very compact and has few parts.

SUMMARY OF THE INVENTION

An object, therefore, of the invention is to provide a new and improved switch actuator of the character described which includes an "overtravel" condition in the switch and which involves movement differential in the switch actuator.

In the exemplary embodiment of the invention, a switch actuator is shown to include a base or housing and a plunger mounted for movement in the base in a given direction from an inoperative position. The plunger has an exposed operating end and an open opposite end communicating with an interior bore extending in the given direction. Relatively movable switch contact means are mounted on the base.

Actuator means are provided for conjoint and relative movement with the plunger, including a grasping portion disposed in the bore of the plunger and an actuating portion exposed from the open end of the plunger. The grasping portion frictionally grasps the plunger interiorly of the bore so as to be movable with the plunger and relatively movable with respect thereto when movement of the actuator means is resisted so the plunger can overtravel the actuator means. The actuating portion is oriented such that movement of the actuator means may effect relative movement of the switch contact means as a result of frictional grasping between the actuator means and the plunger. By positioning the actuator means substantially within the bore of the plunger, the switch actuator can be made very compact and with very few parts.

The invention contemplates constructing the actuator means to substantially eliminate any affects of wear between the plunger and the actuator means. Generally, the actuator means is self-contained and spring loaded for frictionally grasping the plunger by spring biased forces of the grasping portion against interior wall means of the bore of the plunger.

In one form of the invention, the actuator means is fabricated of a single spring wire bent to form a head portion defining the actuating portion and a pair of elongated wire portions defining spring arms extending into the plunger bore. The distal ends of the elongated wire portions or spring arms are bent to form curved portions to engage the interior side walls of the bore.

In another form of the invention, the actuator means is fabricated of a single screw machined component having a head portion defining the actuating portion, the component being split lengthwise away from the head to form a pair of leaf spring portions defining spring arms for biasing against the interior side walls of the plunger bore. The distal ends of the leaf springs are rounded for engaging the side walls of the bore.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
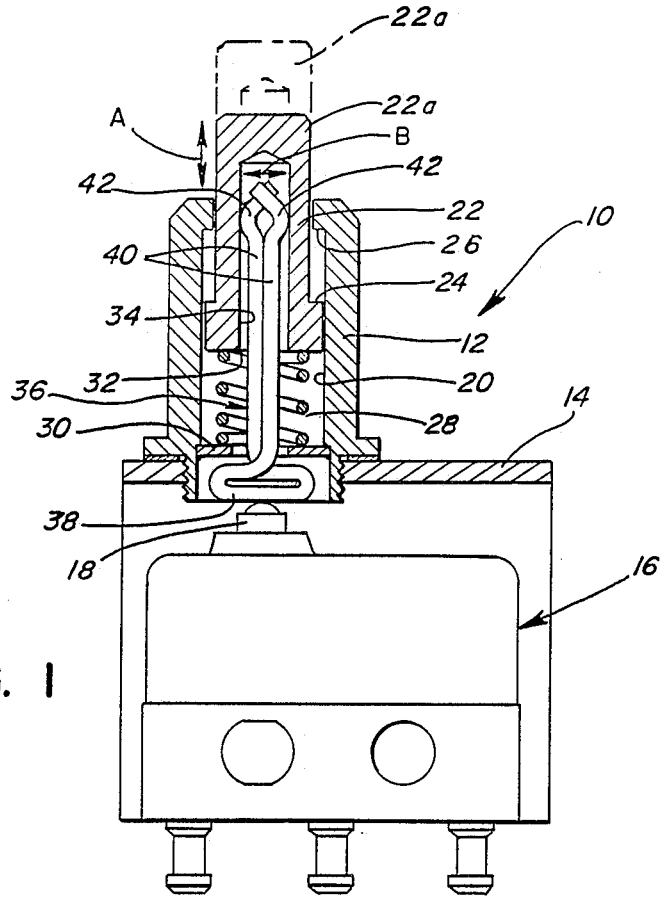
FIG. 1 is a sectional view through one embodiment of a switch actuator incorporating the concepts of the invention.

Referring to the drawings in greater detail, and first to FIG. 1, a switch actuator, generally designated 10, is shown to include base means including a base housing 12 mounted on top of a base frame 14 which mounts or supports a switch, generally designated 16, having movable contact means 18.

Housing 12 has an interior cavity 20 within which is mounted a reciprocally movable plunger 22 which can move generally linearly relative to the housing in the direction of double-headed arrow "A". The plunger can move from an upper or inoperative position shown in phantom, to an operative position shown in full lines. The plunger has an outwardly projecting enlarged portion defining a shoulder 24 for engaging an interior shoulder 26 of housing 12 to define an upper limit position of relative movement of the plunger. A coil spring 28 is disposed within housing cavity 20 and is sandwiched between the lower end of plunger 22 and a washer 30 fixed within cavity 20 at the lower end of housing 12. The coil spring biases the plunger toward its upper limit position, as defined by engagement of plunger shoulder 24 and interior shoulder 26.

Plunger 22 has an upper, exposed operating end 22*a* outside housing 12. The plunger also has an open opposite end 32 defining a mouth communicating with an interior bore 34 extending lengthwise of the plunger or in its direction of movement as indicated by double-headed arrow "A".

The invention contemplates actuator means, generally designated 36, which is self-contained and spring loaded for frictionally grasping plunger 22 by spring-biased forces against the interior walls of bore 34 generally transverse or perpendicular to the direction of movement of the plunger.

Generally, actuator means 36 has a grasping portion disposed in bore 34 and an actuator portion exposed from the open end 32 of the plunger. The grasping portion frictionally grasps the plunger interiorly of the bore so as to be movable with the plunger and relatively movable with respect thereto when movement of the actuator means 36 is resisted, as by engagement with switch contact means 18, so that the plunger can overtravel the actuator means.

Figure 2:
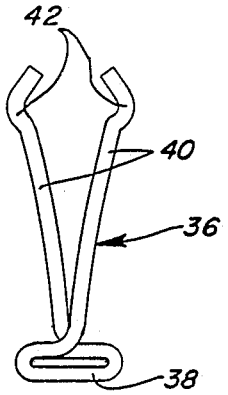
FIG. 2 is an elevational view of the one-piece spring wire which defines the actuator means for the switch actuator of FIG. 1.
Figure 3:
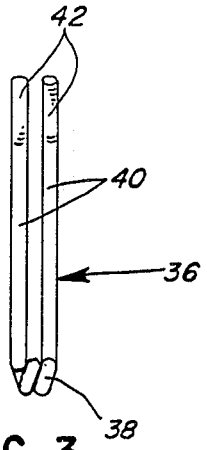
FIG. 3 is an elevational view taken 90 degrees from or looking to the right-hand side of FIG. 2.

More particularly, in the form of the invention shown in FIGS. 1–3, actuator means 34 is formed by a single spring wire (such as "music wire") bent into a configuration as shown best in FIGS. 2 and 3. The single spring wire is bent to form an enlarged head portion 38 which defines the actuating portion of the actuator means for engaging switch contact means 18. A pair of elongated wire portions 40 define spring arms which extend upwardly into plunger bore 34, the spring arms being sort of cantilevered from head portion 38. The distal ends of elongated wire portions 40 are bent outwardly and then inwardly to form curved portions 42 which, as seen in FIG. 1, engage the interior side walls of the bore. The spring wire can be fabricated of carbon steel, for instance.

Initially, the single spring wire is bent to the configuration shown in FIG. 2 where it can be seen that spring arms 40 are spread apart in a "relaxed" condition. In order to spring load the actuator means, the arms are pushed toward each other and inserted into plunger bore 34 as seen in FIG. 1. In this spring loaded condition, the spring arms exert biasing forces in opposite directions against opposite side walls of bore 34, as indicated by double-headed arrow "B". Although the spring arms are cantilevered from head portion 38, they exert spring biased forces substantially perpendicularly against the interior walls of the bore. As seen in FIG. 2, the spring wire actuator means is generally symmetrical and, therefore, equal and opposite forces are exerted against the interior bore walls.

In operation of switch actuator 10 of FIG. 1, plunger 22 would be in its initial or inoperative position as shown in phantom, with coil spring 28 holding plunger shoulder 24 against housing shoulder 26. In this inoperative position, head portion 38 of the spring wire actuator means 36 has been moved upwardly against washer 30, i.e. lifted off of switch contact means 18. Movement of plunger 22 downwardly moves the spring wire actuator means therewith through frictional engagement between wire portions 42 and the interior walls of plunger bore 34. When head portion 38 of the actuator means engages movable switch contact means 18, further movement of the actuator means is resisted as the state of the switch is altered, but plunger 22 can continue to overtravel the actuator means. In the opposite direction, movement of the plunger upwardly will cause the spring wire actuator means to move upwardly therewith, again through the frictional engagement between curved portions 42 of the spring wire form with the interior walls of the bore, to release the switch contacts. Head portion 38 of the spring wire actuator means abuts washer 30, but plunger 22 can continue to move upwardly or overtravel the actuator means, under the influence of coil spring 28, until plunger shoulder 24 engages housing shoulder 26, whereupon the plunger is back to its original inoperative position.

Regardless of the amount of wear between curved portions 42 of the spring wire actuator means 36, continued spring biased forces are applied outwardly against the interior bore walls. This can be understood by noting the spread of spring arms 40 in FIG. 2 and the entire transverse dimensions of plunger 22 in FIG. 1. As a result, switch actuator 10 is substantially immune from wear during use. In addition, the switch actuator is very compact by disposing the actuator means substantially within the plunger bore itself. Very few parts are required and the end result is a much smaller and cost effective, but very functionally effective, switch actuator construction.

Although the surface finish between curved portions 42 of the spring wire actuator means 36 and the interior walls of plunger bore 34 are important in that there should be a smooth feel in operating the switch actuator, the criticality of the surface finish is insignificant when compared with prior switch actuators which rely substantially on these surfaces to continuously provide frictional engagement between the plunger and the actuator means.

Figure 4:
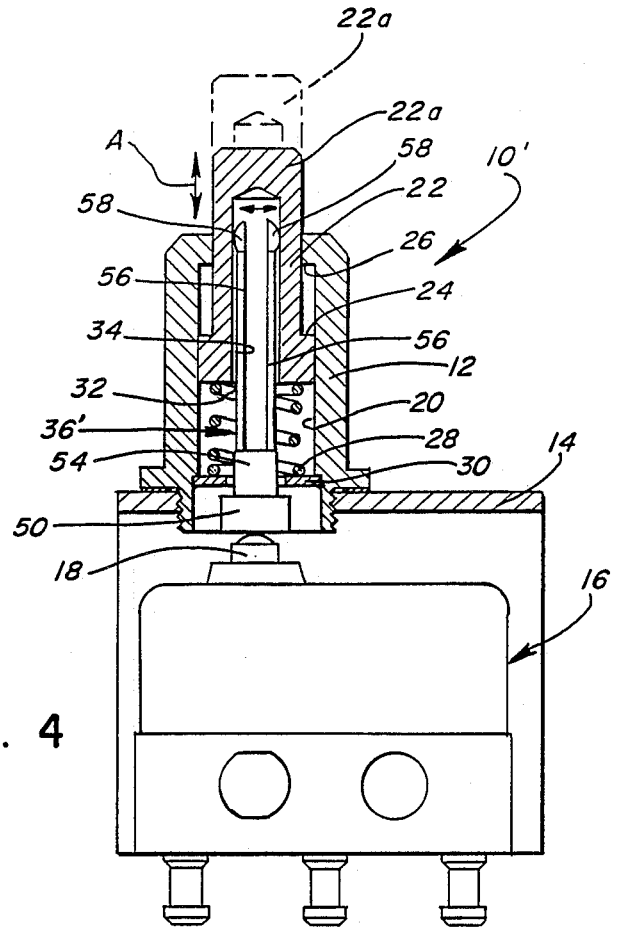
FIG. 4 is a sectional view through another form of switch actuator embodying the concepts of the invention.
Figure 5:
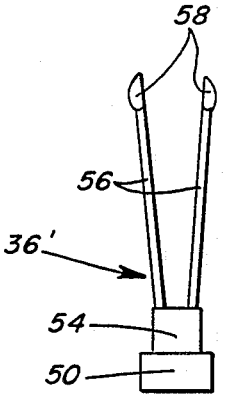
FIG. 5 is an elevational view of the one-piece machined component which forms the actuator means for the embodiment of the invention shown in FIG. 4.

FIGS. 4 and 5 show another form of switch actuator, generally designated 10', according to the invention. The operation of the switch is identical to that described in relation to FIG. 1, and like numerals have been applied in FIG. 4 corresponding to like components described in relation to FIG. 1. In fact, the only difference between the two embodiments is in the switch actuator itself.

Figure 6:
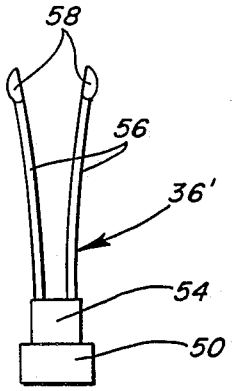
FIG. 6 is a view similar to that of FIG. 5, after the machined component is heat treated.

Specifically, FIG. 4 shows a switch actuator, generally designated 36', which is fabricated in one piece as a single screw machined component, again having a head portion 50 defining the actuating portion of the actuator means for engaging switch contact means 18. The component starts out as an elongated part and is screw machined to form head portion 50, as well as a reduced diameter portion 54 sized to fit within plunger bore 34. The component then is machined to "split" the upper portion thereof into spring arms 56 which are provided with rounded or semispherical distal ends 58. The part is shown in FIG. 5 after splitting and machining processes are completed. The part may be fabricated of stainless steel, carbon steel and the like. After being machined, spring arms 56 are slightly spread and the component is heat treated to maintain a configuration as shown in FIG. 6. The unitary structure then is assembled by pushing the spring arms toward one another and inserting the arms into plunger bore 36 as shown in FIG. 4. Like the single spring wire actuator means of FIGS. 1–3, the spring arms exert equal, opposite and substantially perpendicular biasing forces against the interior walls of the plunger bore. The operation of switch actuator 10', thereafter, is the same as described above in relation to FIG. 1.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A switch actuator, comprising:

base means;

a plunger mounted for movement on the base means in a given direction from an inoperative position, the plunger having an exposed operating end and an open opposite end communicating with an interior bore extending in said given direction;

relatively movable switch contact means mounted to the base means; and actuator means having a grasping portion including at least one spring arm extending into the bore of the plunger and an actuating portion exposed from the open end of the plunger, the at least one spring arm frictionally grasping the plunger interiorly of the bore as to be movable with the plunger and relatively movable with respect thereto when movement of the actuator means is resisted so that the plunger can overtravel the actuator means, the actuating portion being oriented such that movement of the actuator means may effect relative movement of the switch contact means as a result of said frictional grasping.

2. The switch actuator of claim 1 wherein said bore has interior wall means and said at least one spring arm is cantilevered from the actuating portion for applying spring biased forces against the interior wall means of the bore.

3. The switch actuator of claim 2 wherein said bore has opposite side walls, and said at least one spring arm includes a pair of spring arms for applying oppositely directed biasing forces against the opposite side walls of the bore.

4. The switch actuator of claim 3 wherein said pair of spring arms are of substantially identical size and shape for applying equal opposite forces against the opposite side walls of the bore.

5. The switch actuator of claim 3 wherein said actuator means comprises by a single spring wire bent to form head portion defining said actuating portion and a pair of elongated wire portions defining said pair of spring arms.

6. The switch actuator of claim 5 wherein distal ends of said pair of elongated wire portions are bent to form curved portions to engage the side walls of the bore.

7. The switch actuator of claim 3 wherein said actuator means is comprises by a single machined component having a head portion defining said actuating portion and being split lengthwise away from the head portion to form a pair of leaf spring portions defining said pair of spring arms.

8. The switch actuator of claim 7, including rounded portions on distal ends of the pair of leaf spring portions for engaging the interior side walls of the bore.

9. The switch actuator of claim 1, including abutment means on the base means for engaging the actuator means when the plunger moves opposite said given direction so the plunger overtravels the actuator means after the actuating portion moves off of the switch contact means.

10. A switch actuator, comprising:

base means;

a plunger mounted for movement on the base means in a given direction from an inoperative position, the plunger having an exposed operating end and an open opposite end communicating with an interior bore having interior side walls and extending in said given direction;

relatively movable switch contact means mounted to the base means;

actuator means comprising a single spring wire bent to form a head portion exposed from the open end of the plunger and a pair of elongated wire portions defining spring arms for frictionally grasping the plunger by spring biased forces of the spring arms against the interior side walls of the bore whereby the actuator means is relatively movable with respect to the plunger when movement of the actuator means is resisted so that the plunger can overtravel the actuator means, the head portion of the spring wire being oriented such that movement of the actuator means may effect relative movement of the switch contact means as a result of said frictional grasping; and abutment means on the base means for engaging the head portion of the spring wire when the plunger moves opposite said given direction whereby the plunger overtravels the actuator means after the head portion moves off of the switch contact means.

11. The switch actuator of claim 10 wherein distal ends of said pair of elongated wire portions are bent to form curved portions to engage the side walls of the bore.

12. A switch actuator, comprising:

base means;

a plunger mounted for movement on the base means in a given direction from an inoperative position, the plunger having an exposed operating end and an open opposite end communicating with an interior bore having interior side walls and extending in said given direction;

relatively movable switch contact means mounted to the base means;

actuator means comprising a head portion exposed from the open end of the plunger and a pair of elongated spring arms for frictionally grasping the plunger by spring biased forces of the pair of spring arms against the interior side walls of the bore whereby the actuator means is relatively movable with respect to the plunger when movement of the actuator means is resisted so that the plunger can overtravel the actuator means, the head portion being oriented such that movement of the actuator means may effect relative movement of the switch contact means as a result of said frictional grasping; and abutment means on the base means for engaging the head portion of the actuator means when the plunger moves opposite said given direction whereby the plunger overtravels the actuator means after the head portion moves off of the switch contact means.

13. The switch actuator of claim 12, including rounded portions on distal ends of the pair of spring arms for engaging the interior side walls of the bore.

14. The switch actuator of claim 12 wherein said actuator means comprises a single machined component.

* * * * *